US005246355A

United States Patent [19]

Matzner et al.

[11] Patent Number: 5,246,355

[45] Date of Patent: Sep. 21, 1993

[54] WELL SERVICE PUMPING ASSEMBLY

[75] Inventors: Mark D. Matzner; Jimmie L. Yeary, both of Burleson, Tex.

[73] Assignee: Special Projects Manufacturing, Inc., Ft. Worth, Tex.

[21] Appl. No.: 911,751

[22] Filed: Jul. 10, 1992

[51] Int. Cl.[5] ..... F04B 23/04

[52] U.S. Cl. ..... 417/521; 417/568

[58] Field of Search ..... 417/521, 568

[56] References Cited

U.S. PATENT DOCUMENTS

| | | | |
|---|---|---|---|
| 364,627 | 6/1887 | Arnold | 123/197.4 |
| 2,755,739 | 7/1956 | Euwe | 417/568 |
| 2,766,701 | 10/1956 | Giraudeau | 417/568 |

*Primary Examiner*—Richard A. Bertsch
*Assistant Examiner*—Charles G. Freay
*Attorney, Agent, or Firm*—James E. Bradley

[57] ABSTRACT

A pair of well service pumps are mounted on a trailer or skid or bob tail truck chassis in a back-to-back configuration. Each pump has a housing with a cylinder within which a plunger is reciprocally moved. A crankshaft mounts rotatably in the housing perpendicular to the cylinder. The connecting rod connects the crankshaft to a crosshead of the plunger. The axis of rotation of the crankshaft is offset from the cylinder axis. One of the pumps is inverted relative to the other pump so that its offset is the same but in the Opposite direction. The pumps are rotated in the same direction by prime movers.

8 Claims, 2 Drawing Sheets

WELL SERVICE PUMPING ASSEMBLY

BACKGROUND OF THE INVENTION

1. Field of the invention:

This invention relates generally to pumping assemblies for well servicing applications, and in particular to a pump assembly comprising two pumps mounted back-to-back on a trailer or skid.

2. Description of the Prior Art:

Oil and gas wells require servicing such as cementing, gravel packing, and acidizing. All of these services require pumps for pumping fluid down the well.

The type of pump used normally for these applications is a plunger type. It has a crankshaft mounted in a housing. A plunger has a cross head that is reciprocally carried in a cylinder perpendicular to the crankshaft. A connecting rod connects each eccentric portion or journal of the crankshaft to the plunger. A typical pump will be a triplex type having three cylinders, three connecting rods, and three journals on the crankshaft. Normally the axis of rotation of the crankshaft will be intersected by the axis of the cylinder. A diesel engine or other prime mover will connect to a gear train for rotating the crankshaft.

Often these pumps will be mounted on a trailer or skid back-to-back. Each pump has an outboard side connected to a manifold with valves for drawing in and pumping fluid acted on by the plunger. The inboard sides will be located next to each other. A separate prime mover or engine will be connected to each of the pumps.

The overall width from the one manifold to the other manifold should not exceed roadway requirements if the pumps are to be trailer mounted, this being about 8½ feet. This overall width requirement constrains the size of the pumps. Typically the stroke of the plunger can only be four inches in order to meet the 8½ foot space requirement.

It has been known in the past with larger oil field pumps for different applications to increase the stroke by offsetting the crankshaft axis with the cylinder axis. The offset is selected so that during the power or output stroke, the centerline of the crankshaft end of the connecting rod will be located closer to the cylinder axis than the crankshaft axis. As far as is known to Applicant, pumping assemblies with pumps back-to-back as described above have not had vertical offsets.

SUMMARY OF THE INVENTION

In this invention, the crankshaft axis will be offset from the cylinder axis. This results in the centerline of the crankshaft end of the connecting rod being closer to the cylinder axis than the crankshaft axis during the power stroke.

Two of the pumps having the same type of vertically offset axis are employed for trailer or skid applications. The pumps will be identical. However, one of them will be inverted relative to the other. When inverting, one of the pumps will have its crankshaft axis located above the cylinder axis while the other of the pumps will have its crankshaft axis located below the cylinder axis. Both pumps are driven in the same direction by separate prime movers.

This results in one of the pumps having the crankshaft end of the connecting rod above the crankshaft axis during the output stroke, while the other pump has its crankshaft end of the connecting rod located below the crankshaft axis during the output stroke. Because of the offset, a greater stroke can be employed than in the prior art.

DETAILED DESCRIPTION OF THE INVENTION

Figure 1:
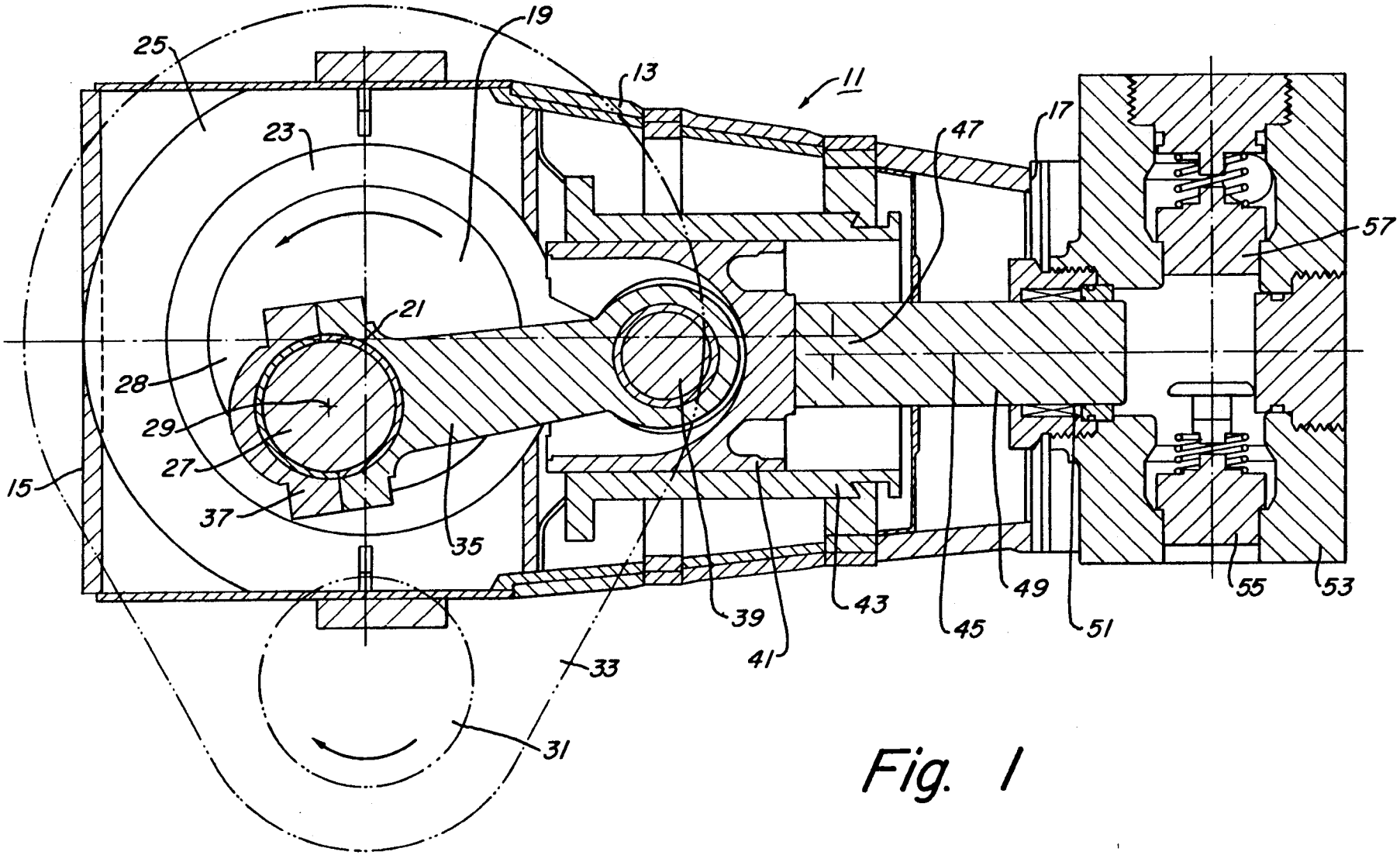
FIG. 1 is a partially schematic, partially sectioned pump constructed in accordance with this invention.

Referring to FIG. 1, a pump 11, referred to herein also as the right side pump, has a housing 13. Housing 13 has an inboard end 15 and an outboard end 17. The outboard end 17 locates next to an outer side of a truck trailer or skid (not shown).

A crankshaft 19 mounts rotatably in housing 13. Crankshaft 19 has a crankshaft axis 21 about which it is rotated. Crankshaft 19 mounts in housing 13 by bearings 23. Bearings 23 are supported on bearing carriers 25 that are stationary interior parts of housing 13. Crankshaft 19 has in the preferred embodiment three journals 27, which are shaft portions connected between cylindrical plates 28. Journals 27 are offset from the crankshaft axis 21. Each journal 27 has a centerline 29. Rotating the crankshaft 19 will cause centerline 29 to orbit crankshaft axis 21. The plates 28 of crankshaft 19 will be supported by bearings 23.

A gear train 31 (shown schematically) will rotate crankshaft 19. Gear train 31 locates in a gear housing 33 and is a conventional part of a means for rotating crankshaft 19. As indicated by the arrows, the prime mover (not shown) or diesel engine that rotates gear train 31 will rotate in a direction that will be opposite to the direction of rotation of crankshaft 19.

A connecting rod 35 for each of the journals 27 has a crankshaft end 37. The crankshaft end 37 mounts rotatably to the journal 27. Each connecting rod 35 has an opposite or crosshead end that mounts to a pin 39 of a crosshead 41. Crosshead 41 reciprocates within a cylinder 43 that is mounted in housing 13. Pin 39 has a pin axis that is perpendicular to and located on the cylinder axis 45.

The axis 45 of cylinder 43 is vertically offset from the crankshaft axis 21. The numeral 47 indicates the offset, and shows in FIG. 1 that the crankshaft axis 21 is located above the cylinder axis 45. The amount of offset is about ¾ inch in the preferred embodiment.

A plunger 49 mounts rigidly to the outboard end of crosshead 41. Plunger 49 extends through bearings and seals 51, reciprocating with crosshead 41. A conventional manifold 53 mounts to the outboard end 17 of housing 13. Manifold 53 has a suction valve 55 and a discharge valve 57, both of Which are spring biased. The reciprocation of the plunger 49 draws fluid into manifold 53 through suction valve 55 and discharges the fluid out discharge valve 57.

Figure 2:
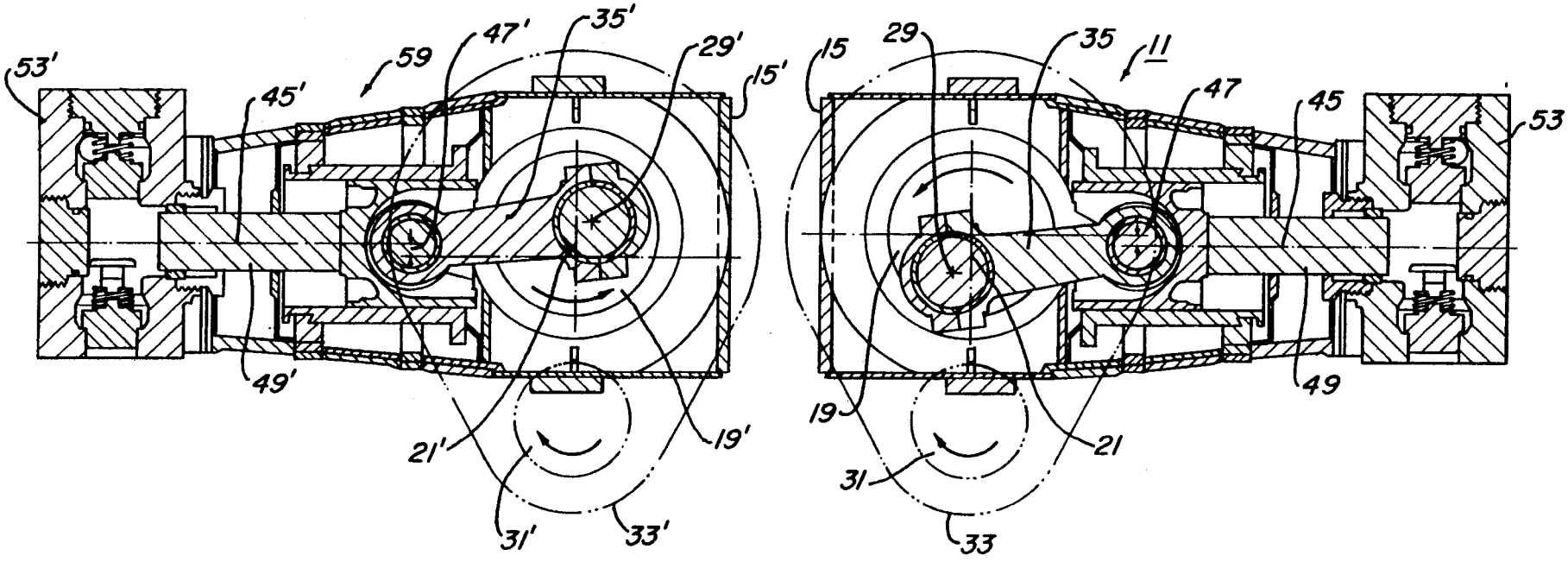
FIG. 2 shows two of the pumps of FIG. 1, one being inverted relative to the other for trailer or skid or bob tail truck chassis mounting.

Referring now to FIG. 2, a left pump 59 is shown mounted back-to-back with right pump 11. Left pump 59 is identical to right pump 11, except that it has been inverted. As a result, the crankshaft axis 21' will be spaced below the cylinder axis 45'. The gear train 31 and gear housing 33 are mounted to left pump 59 opposite from right pump 11 so that when left pump 59 is inverted as shown in FIG. 2, the input coupling of gear train 31' will be located on the lower side of housing 13' just as in right pump 11.

The prime mover (not shown) for left pump 59 rotates in the same direction as the prime mover for right pump 11, as indicated by the arrows. The crankshafts 19 and 19' will thus rotate in the same direction as shown by the arrows. However, because of the inversion, when plunger 49' is in the output or exhaust stroke, the connecting rod centerline 29' will be located above the crankshaft axis 21'. This is opposite from the right pump 11, wherein during the output stroke, the connecting rod centerline 29 locates below the crankshaft axis 21 during the output stroke. In both cases, however, because of the vertical offset 47 and 47', each centerline 29 and 29' will be closer to its cylinder axis 45 and 45' than to the crankshaft axis 21 and 21' during the output stroke. Also, each connecting rod 35, 35' will be at a lesser maximum angle relative to the cylinder axis 45, 45' during the exhaust stroke then during the suction stroke.

In operation, right and left pumps 11 and 59 are constructed with the axis offsets 47 and 47'. Left pump 59 is inverted relative to right pump 11. Gear train 31 and gear housing 33 will be mounted as shown in FIG. 2. Pumps 11, 59 will be mounted to the bed of a truck, with the inboard ends 15 and 15' back-to-back or adjacent each other. Each pump 11, 59 will be connected to a separate prime mover such as a diesel engine. The engines will rotate in the same direction, rotating the crankshafts 19, 19' in the same direction. The plungers 49 and 49' will pump the fluid delivered by the manifolds 53 and 53'.

The invention has significant advantages. By offsetting the axis, a more efficient angle is achieved during the power stroke of the pump. Inverting one of the pumps and placing it back-to-back with the other results in the axis being offset, but in the opposite direction for that pump. Rotating the pumps in the same direction, however, results in the offset increasing the efficiency during the power stroke. This allows a greater stroke to be handled for a given pump size than in the past dual pump application for trailer or skid mounting. A pump as described will produce a six inch stroke versus four inches for a prior art pump of the same size. If desired, a single pump can also be used as it is compact for its capacity.

While the invention has been shown in only one of its forms, it should be apparent to those skilled in the art that it is not so limited but is susceptible to various changes without departing from the scope of the invention.

We claim:

1. A pair of pumps mounted as an assembly, each pump comprising in combination:

a housing having a cylinder which has a cylinder axis, the housing having an inboard side and an outboard side;

a plunger having a crosshead reciprocally carried in the cylinder for movement between a suction stroke and an exhaust stroke;

manifold means mounted to the outboard side of the housing adjacent the cylinder for supplying and delivering liquid acted on by the plunger;

a crankshaft mounted rotatably in the housing and having a crankshaft axis that is perpendicular to the cylinder axis;

a connecting rod having a crankshaft end connected to the crankshaft and a crosshead end connected to the crosshead of the plunger for reciprocating the plunger in response to rotation of the crankshaft, the crankshaft end having a centerline, the crosshead end being connected to the crosshead of the plunger on the cylinder axis;

the pumps being mounted with their inboard sides adjacent each other;

means for rotating the crankshaft of each of the pumps in the same direction; and the crankshaft axis of each pump being vertically offset from the cylinder axis such that in one of the pumps, the crankshaft axis is spaced above the cylinder axis and in the other of the pumps, the crankshaft axis is spaced below the cylinder axis, and wherein in each of the pumps, the crankshaft end of the connecting road is vertically closer to the cylinder axis than the crankshaft axis during the exhaust stroke.

2. The pair of pumps according to claim 1 wherein the pump which has its crankshaft axis spaced above the cylinder axis, the plunger is in its exhaust stroke when the centerline of the crankshaft end of the connecting rod is located below the cylinder axis.

3. The pair of pumps according to claim 1 wherein in the pump which has its crankshaft axis spaced below the cylinder axis, the plunger is in its exhaust stroke when the centerline of the crankshaft end of the connecting rod is located above the cylinder axis.

4. The pair of pumps according to claim 1 wherein the magnitude of the offset is substantially the same for each of the pumps.

5. The pair of pumps according to claim 1 wherein the pumps are substantially identical to each other, with one being inverted from the other.

6. Right and left pumps mounted as an assembly, each pump comprising in combination:

a housing having a cylinder which has a cylinder axis, the housing having an inboard side and an outboard side;

a plunger having a crosshead reciprocally carried in the cylinder for movement between a suction stroke and an exhaust stroke;

manifold means mounted to the outboard side of the housing adjacent the cylinder for supplying and delivering liquid acted on by the plunger;

a crankshaft mounted rotatably in the housing and having a crankshaft axis that is perpendicular to the cylinder axis;

a connecting rod having a crankshaft end connected to the crankshaft and a crosshead end connected to the crosshead of the plunger for reciprocating the plunger in response to rotation of the crankshaft, the crankshaft end having a centerline, the crosshead end of the connecting rod being on the cylinder axis;

the pumps being mounted with their inboard sides adjacent each other;

means for rotating the crankshaft of each of the pumps in the same direction, such that the centerline of the crankshaft end of the connecting rod is below the cylinder axis during the exhaust stroke on the right pump and the centerline of the crankshaft end of the connecting rod is above the cylinder axis during the exhaust stroke on the left pump; and the crankshaft axis being vertically offset from the cylinder axis in each of the pumps by substantially the same amount, wherein in the right pump, the crankshaft axis is spaced above the cylinder axis and in the left pump, the crankshaft axis is spaced below the cylinder axis, such that during the exhaust stroke of each of the pumps, the connecting rod will be at a lesser maximum angle relative to the cylinder axis than during the suction stroke.

7. The pair of pumps according to claim 6 wherein the pumps are substantially identical to each other, with one being inverted from the other.

8. A method of pumping fluid, comprising:

providing a housing having a cylinder which has a cylinder axis, the housing having an inboard side and an outboard side;

mounting a plunger with a crosshead reciprocally in the cylinder for movement between a suction stroke and an exhaust stroke;

mounting a manifold to the outboard side of the housing adjacent the cylinder;

mounting a crankshaft rotatably in the housing with a crankshaft axis perpendicular to the cylinder axis;

providing a connecting rod and connecting a crankshaft end of the connecting rod to the crankshaft and a crosshead end of the connecting rod to the crosshead of the plunger on the cylinder axis;

mounting the crankshaft axis of each pump so that it is vertically offset from the cylinder axis, such that during the exhaust stroke, a centerline of the crankshaft end of the connecting rod in each of the pumps will be spaced closer to the cylinder axis than during the suction stroke;

inverting one of the pumps and mounting the pumps with their inboard sides adjacent each other, resulting in the crankshaft axis being spaced above the cylinder axis in one of the pumps and below the cylinder axis in the other of the pumps; then rotating the crankshaft of each of the pumps in the same direction to cause the plungers to reciprocate in the cylinders to pump fluid supplied by the manifold, the vertical offset of the crankshaft axis of each pumps resulting in each of the connecting rods being at a lesser maximum angle relative to the cylinder axis during the exhaust stoke than during the suction stroke.

* * * * *